US009702078B2

(12) United States Patent
Lee

(10) Patent No.: US 9,702,078 B2
(45) Date of Patent: Jul. 11, 2017

(54) WASHING MACHINE

(71) Applicant: Samsung Electronics Co., Ltd., Suwon-si (KR)

(72) Inventor: Sang Up Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 20 days.

(21) Appl. No.: 14/720,002

(22) Filed: May 22, 2015

(65) Prior Publication Data

US 2015/0337480 A1 Nov. 26, 2015

(30) Foreign Application Priority Data

May 22, 2014 (KR) ..... 10-2014-0061506
Dec. 1, 2014 (KR) ..... 10-2014-0169985

(51) Int. Cl.
*D06F 39/02* (2006.01)
*D06F 39/08* (2006.01)
*D06F 23/04* (2006.01)

(52) U.S. Cl.
CPC ..... *D06F 39/02* (2013.01); *D06F 39/028* (2013.01); *D06F 23/04* (2013.01); *D06F 39/088* (2013.01)

(58) Field of Classification Search
CPC ..... D06F 39/02; D06F 39/028
See application file for complete search history.

(56) References Cited

U.S. PATENT DOCUMENTS 5,473,914 A * 12/1995 Pyo ..... D06F 39/02 68/17 R
5,483,989 A * 1/1996 Lim ..... A47L 15/44 137/268

(Continued)

FOREIGN PATENT DOCUMENTS

JP 8-215482 8/1996
KR 1994-019347 8/1994

(Continued)

OTHER PUBLICATIONS

Korean Office Action issued Sep. 30, 2015 in corresponding Korean Patent Application No. 10-2014-0169985.

(Continued)

*Primary Examiner* — David Cormier
(74) *Attorney, Agent, or Firm* — Staas & Halsey LLP

(57) ABSTRACT

A washing machine including a body, a rotary tub disposed inside the body, and a detergent containing unit installed on the body to dissolve a detergent in washing water to supply the detergent. The detergent containing unit includes a housing coupled with the inside of the body, a detergent container contained in the housing to contain the detergent, and a rotary device rotatably coupled with at least part of a path through which the detergent moves to dissolve the detergent in the washing water. A dissolving ability of the detergent may be improved. Also, it is possible to dissolve a solid detergent and a liquid detergent in one detergent containing unit without an additional component. Also, since it is possible to prevent residual detergent from being left in the detergent containing unit after washing, it is unnecessary to additionally use a rinse function to clean the detergent containing unit.

23 Claims, 17 Drawing Sheets

(56) References Cited

U.S. PATENT DOCUMENTS

| | | | | |
|---|---|---|---|---|
| 2011/0041567 | A1* | 2/2011 | Ko | D06F 31/00 68/17 R |
| 2012/0096903 | A1* | 4/2012 | Kim | D06F 39/02 68/17 R |
| 2013/0047678 | A1* | 2/2013 | Lee | D06F 39/028 68/13 R |

FOREIGN PATENT DOCUMENTS

| | | |
|---|---|---|
| KR | 1995-0025177 | 9/1995 |
| KR | 1996-008155 | 3/1996 |
| KR | 1998-065193 | 10/1998 |
| KR | 10-2010-0011255 | 2/2010 |
| KR | 10-2011-0004750 | 1/2011 |
| KR | 10-2013-0022983 | 3/2013 |

OTHER PUBLICATIONS

International Search Report issued Aug. 28, 2015 in corresponding International Patent Application No. PCT/KR2015/004991.

* cited by examiner

WASHING MACHINE

CROSS-REFERENCE TO RELATED APPLICATION

This application claims the benefit of Korean Patent Application Nos. 10-2014-0061506 and 10-2014-0169985, filed on May 22, 2014 and Dec. 1, 2014, respectively, in the Korean Intellectual Property Office, the disclosures of which are incorporated herein by reference.

BACKGROUND

1. Field

Embodiments relate to a washing machine, and more particularly, to a washing machine having an improved a detergent container.

2. Description of the Related Art

Generally, washing machines are apparatuses for washing laundry by rotating a cylinder-shaped rotary tub filled with laundry and washing water. As a type of washing machines, there are drum washing machines and pulsator washing machines. In the case of drum washing machines, a rotary tub is horizontally disposed and laundry is lifted upward and falls along an inner circumference of the rotary tub when the rotary tub forwardly or reversely rotates on a horizontal axis, thereby washing the laundry. In the case of pulsator washing machines, a rotary tub including a pulsator is vertically disposed and laundry is washed using a water current generated by the pulsator when the rotary tub forwardly or reversely rotates on a vertical axis.

In upper portions of drum washing machines or pulsator washing machines, a detergent containing unit is installed to dissolve a detergent in washing water supplied into the inside of the rotary tub from an external water source and supply the detergent dissolved in the washing water into the rotary tub.

General detergent containing units include a solid detergent container for containing a powder type detergent formed of particles and a liquid detergent container for containing a liquid type detergent, which are separated. When the liquid type detergent is used, it is necessary to couple an additional liquid detergent container with a detergent containing unit.

SUMMARY

Therefore, it is an aspect of at least one embodiment to provide a washing machine including a detergent containing unit having an improved configuration to increase a detergent dissolving ability.

Additional aspects of embodiments will be set forth in part in the description which follows and, in part, will be obvious from the description, or may be learned by practice of the invention.

In accordance with an aspect of an embodiment, a washing machine includes a body, a rotary tub disposed inside the body, and a detergent containing unit installed on the body to dissolve a detergent in washing water to supply the detergent, in which the detergent containing unit includes a housing coupled with the inside of the body, a detergent container contained in the housing to contain the detergent, and a rotary device rotatably coupled with at least part of a path through which the detergent moves to dissolve the detergent in the washing water.

The rotary device may be coupled with the inside of the detergent container.

The washing machine may further include a siphon pipe configured to protrude from a bottom side of the detergent container and having at least one first flow path, in which the rotary device may be coupled with the siphon pipe.

The rotary device may include a coupled portion coupled with the siphon pipe to have a gap therebetween and a plurality of blades configured to extend from the coupled portion and rotate inside the detergent container.

A water supply hole configured to supply the washing water to the detergent container may be provided in a rear side of the detergent container.

The water supply hole may be coupled with a nozzle device including a washing water inlet hole and at least one air inlet hole to mix the washing water with air and supply the washing water mixed with the air to the detergent container.

A cross-sectional area of the washing water inlet hole of the nozzle device may decrease toward the air inlet hole.

The washing water inlet hole and the air inlet hole of the nozzle device may be formed as a single member.

The nozzle device may include a nozzle in which the washing water inlet hole is formed and a nozzle housing in which the nozzle is inserted and the air inlet hole is formed.

An elastic member configured to press the nozzle depending on a pressure of the washing water, which flows into the nozzle, to guide the nozzle to move forward and backward may be inserted between the nozzle housing and the nozzle.

The nozzle device may further an inflow preventer configured to close a flow path through which the washing water flows, to prevent the washing water from flowing into the detergent container when the detergent container is withdrawn.

The washing machine may further include a guide cover coupled with the inside of the housing to cover a top side of the detergent container to guide a moving direction of the washing water.

The guide cover may include at least one rib configured to extend downward from the guide cover to guide the moving direction of the washing water.

The rib may include a first rib provided on a front side of the guide cover to prevent the supplied washing water from overflowing a front side of the detergent container, a second rib configured to nearly circularly extend from a center of the guide cover toward an edge thereof to guide the washing water to a center of the detergent container, and a third rib configured to radially extend from the guide cover toward the edge to intensively supply the washing water to a specific section.

The guide cover may further include a contact preventer provided in the center thereof and located at a level lower than the rib to prevent a contact with the rotary device.

In accordance with another aspect of an embodiment, a washing machine includes a body, a rotary tub disposed inside the body, a detergent containing unit including a housing and a detergent container contained in the housing to contain a detergent, and at least one nozzle device connected to a rear side of the detergent container and configured to directly supply washing water into the detergent container.

The nozzle device may be connected to a water supply hole provided in the rear side of the detergent container.

The nozzle device may include a washing water inlet hole and at least one air inlet hole to mix the washing water with air and supply the washing water mixed with the air to the detergent container.

A cross-sectional area of the washing water inlet hole may decrease toward the air inlet hole.

The washing machine may further include a rotary device rotatably coupled with the inside of the detergent container and including a coupled portion coupled with the detergent container and a plurality of blades configured to extend from the coupled portion to rotate inside the detergent container.

The coupled portion may be coupled with a siphon pipe configured to protrude from a bottom side of the detergent container and including at least one first flow path.

The washing machine may further include a guide cover coupled with the inside of the housing to cover a top side of the detergent container and configured to guide a moving direction of the washing water.

In accordance with still another aspect of an embodiment, a washing machine includes a body, a rotary tub disposed inside the body, and a detergent container detachably coupled with the inside of the body and including a detergent containing space for containing a detergent and a softener containing space for containing a softener, in which the detergent containing space includes a rotary device configured to dissolve a solid type detergent and a siphon pipe configured to protrude from a bottom side to dissolve and discharge a liquid type detergent.

The rotary device may include a coupled portion coupled with the siphon pipe and a plurality of blades configured to extend from the coupled portion to rotate inside the detergent containing space.

The washing machine may further include a nozzle coupled with a rear side of the detergent containing space to mix the washing water with air to allow the washing water mixed with the air to flow into the detergent containing space.

The washing machine may further include a guide cover configured to cover a top side of the detergent containing space and including at least one rib to guide a moving direction of the washing water.

In accordance with yet another aspect of an embodiment, a washing machine includes a body, a rotary tub disposed inside the body, a detergent containing unit including a housing coupled with the inside of the body and a detergent container contained in the housing to contain a detergent, and at least one nozzle device including a nozzle configured to spray washing water into the detergent container, in which the nozzle is configured to move toward one of the housing and the detergent container depending on a pressure of the washing water which flows into the detergent containing unit.

The nozzle device may include the nozzle, a nozzle housing configured to contain the nozzle, and an elastic member inserted between the nozzle and the nozzle housing and configured to guide movement of the nozzle.

In accordance with a further aspect of an embodiment, a washing machine includes a body, a rotary tub disposed inside the body, a detergent containing unit including a housing coupled with the inside of the body and a detergent container contained in the housing to contain a detergent, and at least one nozzle device configured to spray washing water into the detergent container, in which the nozzle device includes an inflow preventer configured to pivot between a first state of opening a flow path of the washing water sprayed into the detergent container and a second state of closing the flow path of the washing water sprayed to the detergent container.

The nozzle device may further include a nozzle configured to spray the washing water into the detergent container and a nozzle housing configured to contain the nozzle, wherein the inflow preventer is coupled with one side of the nozzle housing.

In accordance with still further aspect of an embodiment, a washing machine includes a body, a rotary tub disposed inside the body, a detergent container detachably coupled with the inside of the body to contain a detergent, a guide cover configured to cover a top side of the detergent container, and at least one nozzle device connected to a rear side of the detergent container and coupled with at least part of the guide cover to spray washing water into the detergent container.

The nozzle device may include a nozzle configured to spray the washing water into the detergent container and a nozzle housing configured to contain the nozzle, and the nozzle housing may be coupled with a protruding portion which protrudes from the guide cover toward the nozzle housing.

BRIEF DESCRIPTION OF THE DRAWINGS

These and/or other aspects of embodiments will become apparent and more readily appreciated from the following description of the embodiments, taken in conjunction with the accompanying drawings of which.

DETAILED DESCRIPTION

Hereinafter, various embodiments of the present invention will be described in detail with reference to the attached drawings. Hereinafter, a pulsator washing machine will be described as an example. However, it is not limited thereto. A detergent containing unit according to embodiments may be applied to a drum washing machine.

Figure 1:
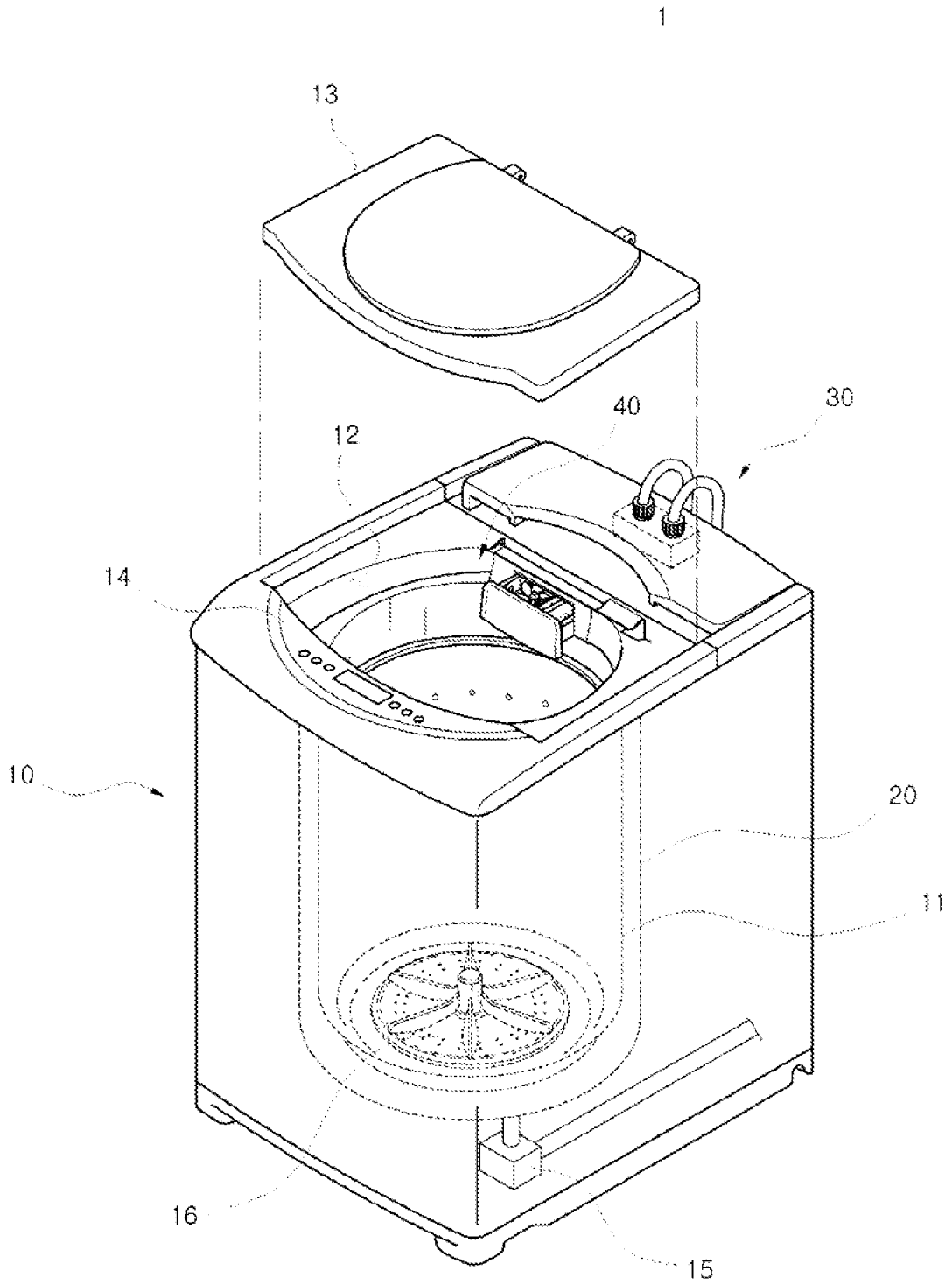
FIG. 1 is a configuration view of a washing machine in accordance with an embodiment.

FIG. 1 is a configuration view of a washing machine 1 in accordance with an embodiment.

As shown in FIG. 1, the washing machine 1 may include, or example, a body 10 configured to form an exterior, a tub 20 installed inside the body 10 and configured to contain washing water, and a rotary tub 11 rotatably installed inside the tub 20.

Also, there may also be included a water supply apparatus 30 configured to supply water into the body 10 and a detergent containing unit 40 configured to mix the water supplied from the water supply apparatus 30 with a detergent and to supply the water mixed with the detergent to the tub 20.

An opening 12 may be formed on a top of the body 10 to load and unload laundry, and a top cover 13 capable of opening and closing may be installed on the opening 12. On the top front part of the body 10, there may be installed a manipulation panel 14 including a plurality of manipulation buttons and a display displaying an operation state to allow a user to control operations of the washing machine 1.

Inside the body 10, there may be installed the tub 20 configured to contain the washing water, the rotary tub 11 configured to rotate inside the tub 20, and a pulsator 16 configured to form a water current for washing on a bottom inside the rotary tub 11.

On a bottom of the tub 20 inside the body 10, there may be provided a driving unit (not shown) configured to drive the rotary tub 11 and the pulsator 16 and a drainage system 15 configured to drain the washing water.

The washing machine 1 performs washing, in which the pulsator 16 may repetitively rotate in a forward direction and a reverse direction due to the driving unit after the tub 20 is filled with the washing water including the detergent and laundry is contained inside the rotary tub 11.

After the washing operation, while operations of water supply and draining are being repetitively performed, a rinse operation for the laundry may be performed through the same operation as the washing operation described above and the draining operation is performed through the drainage system 15 after the rinse operation. Also, after the draining, the rotary tub 11 may rotate at a high speed to spin-dry the laundry.

Figure 2:
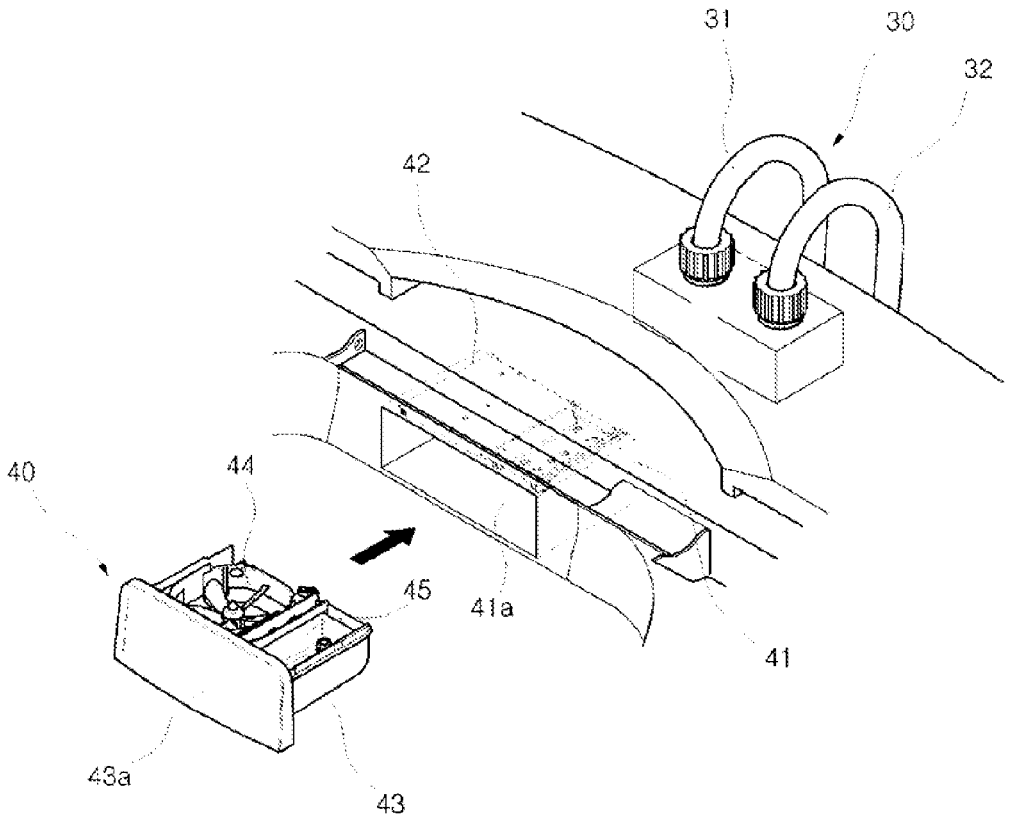
FIG. 2 is a view illustrating a state in which a detergent containing unit is withdrawn from the washing machine of in accordance with an embodiment.
Figure 3:
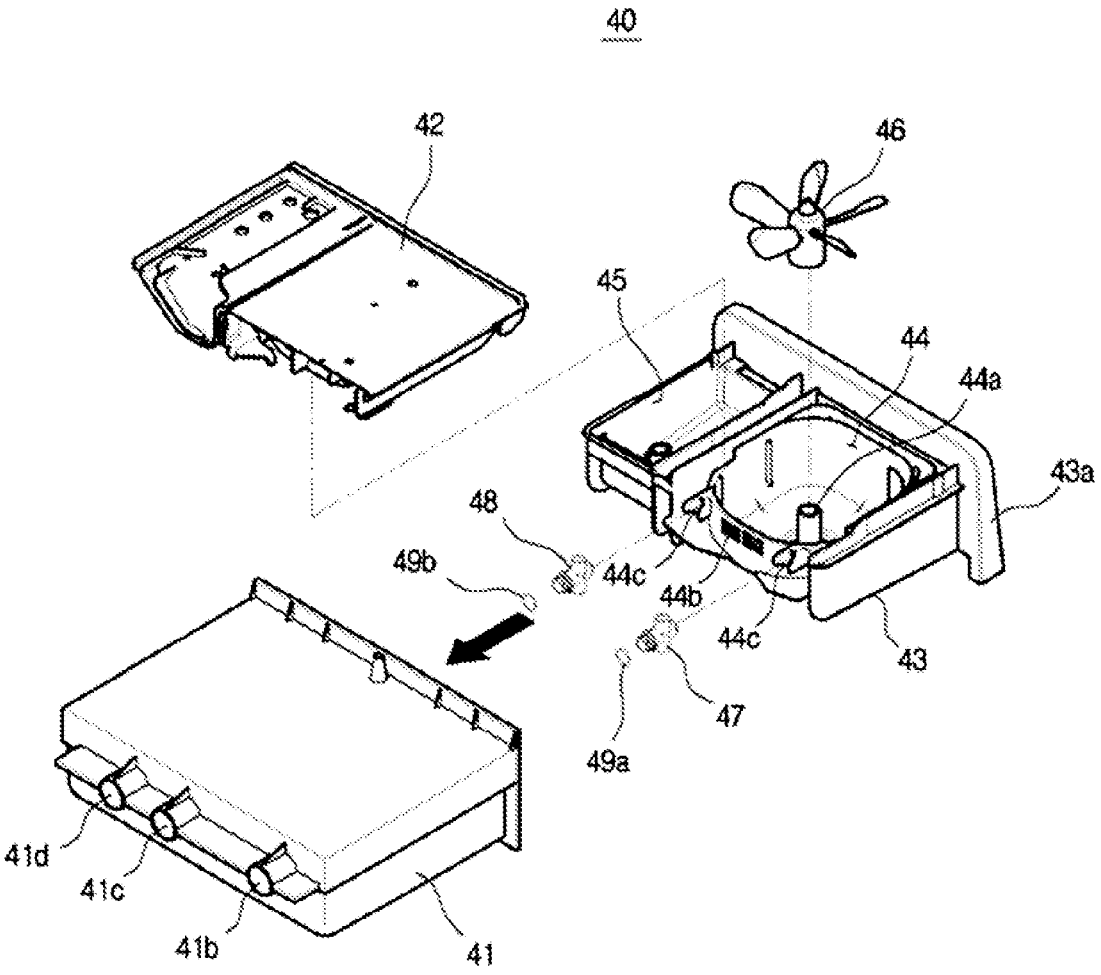
FIG. 3 is an exploded view of the detergent containing unit of in accordance with an embodiment.

FIG. 2 is a view illustrating a state in which the detergent containing unit 40 according to an embodiment is withdrawn from the washing machine 1. FIG. 3 is a configuration view of the detergent containing unit 40 according to an embodiment.

As shown in FIGS. 2 and 3, the water supply apparatus 30 may be installed in the top rear part of the body 10. The water supply apparatus 30 may include first water supply pipes 31 and 32 extending from a water source, a water supply valve (not shown) configured to connect to the first water supply pipes 31 and 32 to open and close the first water supply pipes 31 and 32, and a plurality of second water supply pipes (not shown) configured to connect the water supply valve to the detergent containing unit 40.

The first water supply pipes 31 and 32 may include a hot water supply pipe 31 connected to an external hot water source and a cold water supply pipe 32 connected to an external cold water source. The water supply valve may include a hot water supply valve connected to the hot water supply pipe 31 and a cold water supply valve connected to the cold water supply pipe 32. It is possible to selectively supply water to one side or the other through a flow path diversion of a valve.

The detergent containing unit 40 may include a housing 41 coupled with the inside of the body 10 and a detergent container 43 contained in the housing 41 to contain a detergent. The housing 41 may have an open front side and includes a container containing space 41*a*, thereby containing the detergent container 43. The detergent container 43 may be detachable from the housing 41. Accordingly, a user may withdraw the detergent container 43 when necessary and may fill the detergent container 43 with a detergent.

On the front side of the detergent container 43, a grip portion 43*a* may be provided to allow the user to withdraw the detergent container 43. The detergent container 43 may include a detergent containing space 44 configured to contain the detergent and a softener containing space 45 configured to contain a softener.

A guide cover 42 configured to cover a top side of the detergent container 43 may be coupled with the inside of the housing 41. The guide cover 42 may be fixed to the inside of the housing 41 and may guide a moving direction of washing water which flows into to the detergent container 43.

The detergent container 43 may be configured to have four sides which are closed and to have a concave shape in order to stably contain a liquid detergent and a liquid type softener.

To dissolve the detergent in the washing water, a rotary device 46 may be rotatably coupled with at least a part of a path through which the detergent moves. According to an embodiment, the rotary device 46 may be rotatably coupled with the inside of the detergent container 43 to dissolve the detergent in the washing water. However, it is not limited thereto. The rotary device 46 may be coupled with at least the part of the path through which the detergent moves even when the part is on the outside of the detergent container 43. That is, the rotary device 46 may be coupled with the outside of the detergent container 43 or may be provided inside a connection pipe (not shown) connecting the detergent container 43 to the body 10. When the rotary device 46 is coupled with the connection pipe, the detergent contained in the detergent container 43 may flow into the connection pipe and may be dissolved in the washing water by the rotary device 46 in the connection pipe.

In more detail, the rotary device 46 may be coupled with the detergent containing space 44. On a bottom side of the detergent containing space 44, a siphon pipe 44*a* configured to at least partially extend upwardly and to have at least one flow path may be provided. The rotary device 46 may be coupled with the siphon pipe 44*a*. The siphon pipe 44*a* may have a cylindrical shape.

In a rear side of the detergent container 43, a water supply hole 44*c* configured to supply the washing water to the detergent container 43 may be provided. As shown in the drawings, two water supply holes 44*c* may be provided in the rear side of the detergent containing space 44. However, it is not limited thereto but one or more water supply holes 44*c* may be provided.

The water supply holes 44*c* may be connected to water supply hoses 41*b* and 41*c* of the housing 41. The water supply hoses 41*b* and 41*c* may be provided in a rear side of the housing 41. In a rear of the housing 41, a discharge hose 41*d* configured to discharge the washing water overflowing from the detergent container 43 may be provided in addition to the water supply hoses 41*b* and 41*c*. According to an embodiment, one discharge hose 41*d* and two water supply hoses 41*b* and 41*c* may be provided but it is not limited thereto.

On a rear side of the detergent container 43, a nozzle device configured to mix the washing water with air and supply the washing water mixed with the air into the detergent container 43 may be provided to communicate with the rear side of the detergent container 43. The nozzle device may include nozzles 47 and 48 configured to spray the washing water into the detergent container 43. The nozzles 47 and 48 may be coupled with the water supply holes 44*c*. According to an embodiment, since there are two water supply holes 44*c*, two nozzles 47 and 48 may be provided. The nozzles 47 and 48 may include a washing water inlet hole 47*a* (refer to FIG. 8) into which the washing water flows and air inlet holes 47*b* and 47*c* (refer to FIG. 8) into which air flows, which will be described below. The nozzles 47 and 48 may be coupled with the inside of the housing 41 and may communicate with the water supply holes 44*c*. However, it is not limited thereto but the nozzles 47 and 48 may be directly coupled with the water supply holes 44*c*.

The nozzles 47 and 48 may be coupled to intervene between the water supply holes 44*c* and the water supply hoses 41*b* and 41*c*. Antifriction parts 49*a* and 49*b* may be fitted on the nozzles 47 and 48. The antifriction parts 49*a* and 49*b* are configured to prevent friction between the nozzles 47 and 48 and the water supply hoses 41*b* and 41*c* and may have a ring shape. Also, the antifriction parts 49*a* and 49*b* may be formed of a flexible material to prevent friction.

Figure 4:
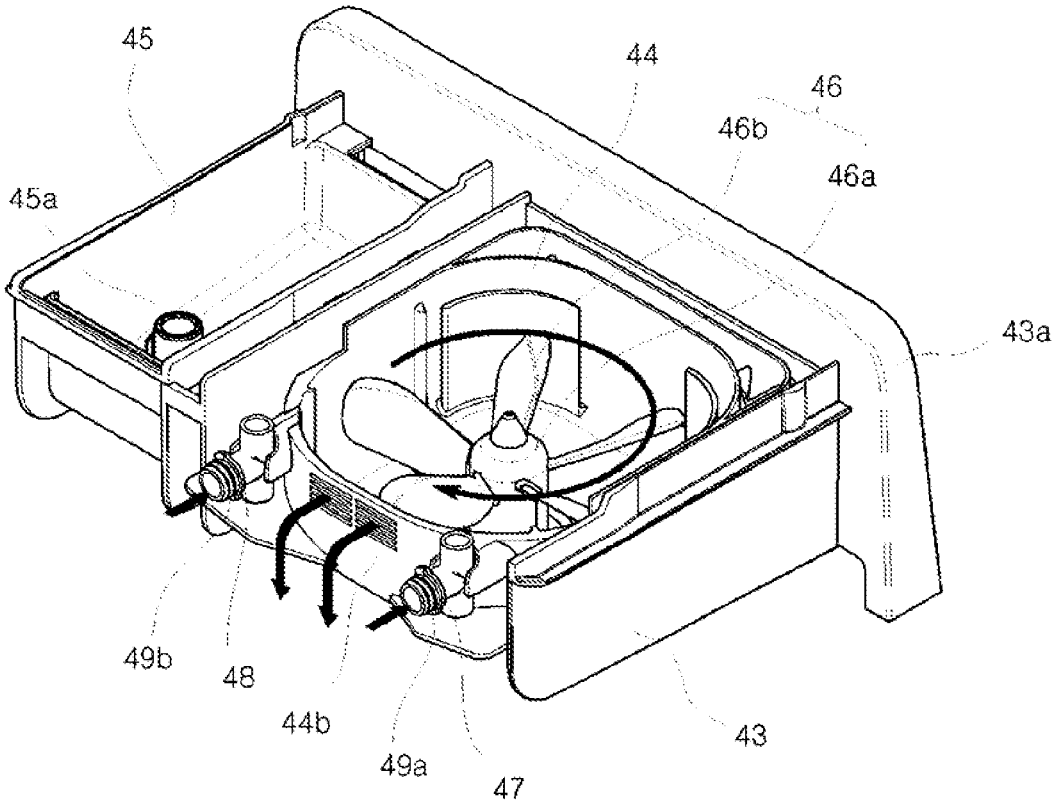
FIG. 4 is a perspective view of a detergent container of the detergent containing unit in accordance with an embodiment.
Figure 5:
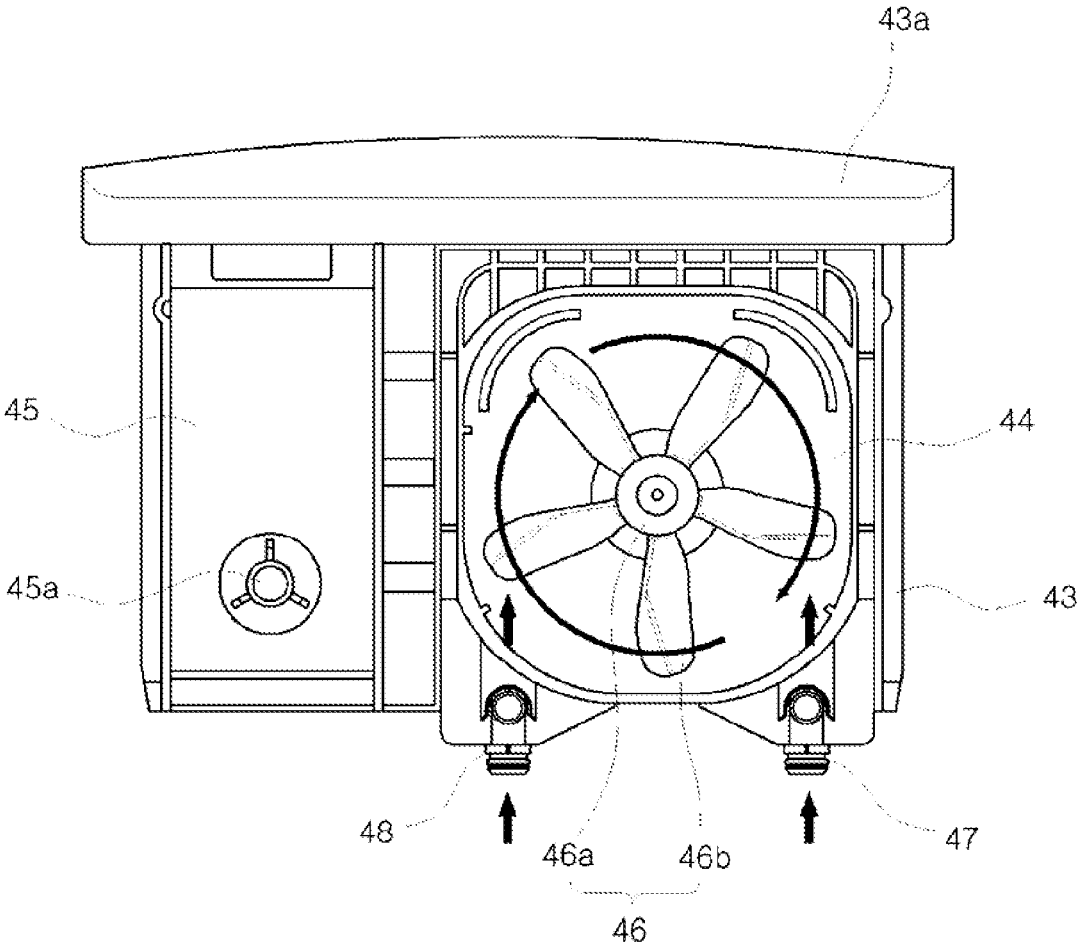
FIG. 5 is a top view of the detergent container of the detergent containing unit in accordance with an embodiment.

FIG. 4 is a perspective view of the detergent container 43 according to an embodiment. FIG. 5 is a top view of the detergent container 43 according to an embodiment.

As shown in FIGS. 4 and 5, the rotary device 46 may be coupled with the inside of the detergent containing space 44. The rotary device 46 may include a coupled portion 46*a* coupled with the siphon pipe 44*a* protruding from a bottom side of the detergent containing space 44 and a plurality of blades 46*b* configured to extend from the coupled portion 46*a* and rotate inside the detergent containing space 44. According to an embodiment, an angle between the plurality of blades 46*b* and the bottom side of the detergent containing space 44 may not be 0°.

When the washing water is supplied into the detergent containing space 44, a whirling vortex may be formed inside the detergent containing space 44, thereby dissolving the detergent inside the detergent containing space 44. Particularly, the washing water of the nozzles 47 and 48 flows into the detergent containing space 44 while being mixed with the air, thereby promoting the dissolution of the detergent.

When the washing water is supplied into the detergent containing space 44, due to a pressure of the washing water sprayed from the nozzles 47 and 48 and the whirling vortex, the blades 46*b* of the rotary device 46 may rotate. Accordingly, a water current is formed inside the detergent containing space 44, thereby dissolving the detergent. Particularly, when a solid detergent is contained in the detergent containing space 44, a residual solid mass left in at least one part in the detergent containing space 44 may be pulverized and dissolved.

An outlet 44*b* may be provided in an upper portion of the detergent containing space 44. The dissolved detergent may be discharged through the outlet 44*b*. According to an embodiment, the outlet 44*b* may have a slit shape. Accordingly, when a mass of the solid detergent is left, it is impossible for the solid detergent to be discharged through the outlet 44*b*. The detergent discharged through the outlet 44*b* may flow into the rotary tub 11 through the discharge hose 41*d* and may be used to wash the laundry.

The washing water left inside the detergent containing space 44 may be discharged through the siphon pipe 44*a* coupled to be located inside the coupled portion 46*a* of the rotary device 46. It will be described below.

To form a second flow path, a siphon pipe 45*a* having a protruding bottom side may be provided in the softener containing space 45. The softener in the softener containing space 45 may be dissolved in the washing water and may flow into the rotary tub 11 through the siphon pipe 45*a*.

Figure 6:
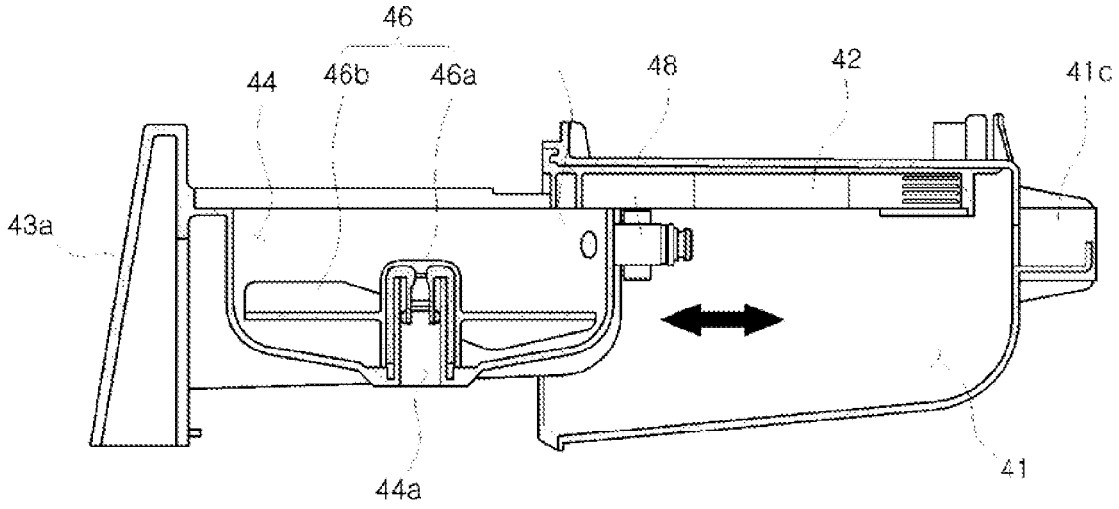
FIG. 6 is a side cross-sectional view illustrating a state in which the detergent container of the detergent containing unit in accordance with an embodiment is withdrawn.
Figure 7:
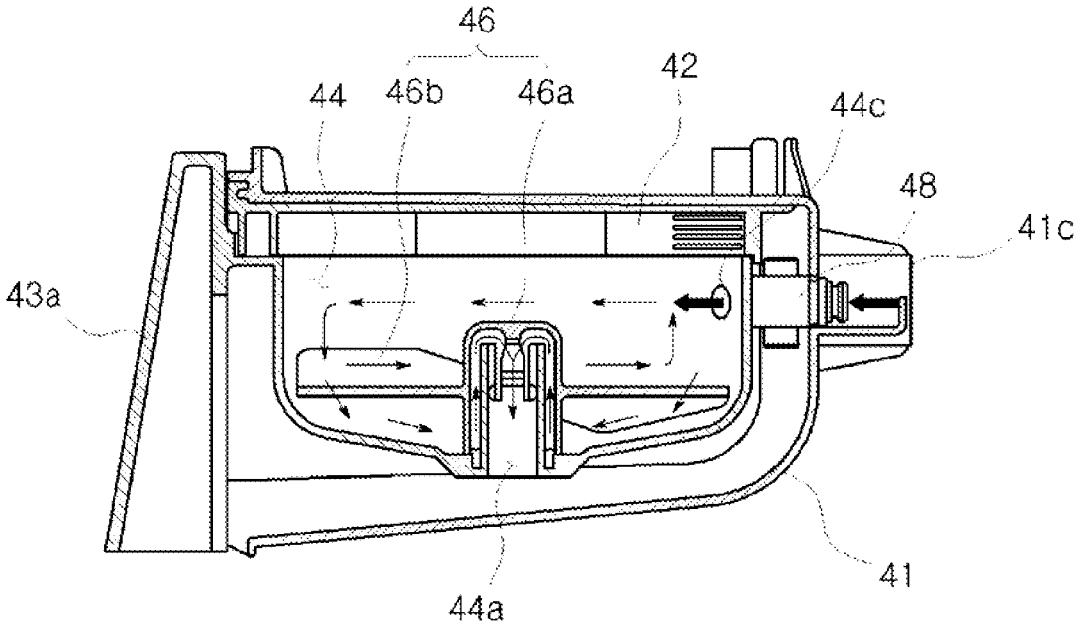
FIG. 7 is a side cross-sectional view illustrating a state in which the detergent container of the detergent containing unit in accordance with an embodiment is contained.

FIG. 6 is a side cross-sectional view illustrating a state in which the detergent container 43 of the detergent containing unit 40 according to an embodiment is withdrawn. FIG. 7 is a side cross-sectional view illustrating a state in which the detergent container 43 of the detergent containing unit 40 according to an embodiment is contained.

As shown in FIGS. 6 and 7, the detergent container 43 of the detergent containing unit 40 may be withdrawn from the housing 41. Since it is coupled with the top side of the housing 41, the guide cover 42 is not withdrawn when the detergent container 43 is withdrawn.

The siphon pipe 44*a* of the detergent containing space 44 may be located at a level lower than four sidewalls of the detergent containing space 44. Accordingly, liquid in the detergent containing space 44 may be discharged first through the siphon pipe 44*a* except when the liquid overflows the sidewalls of the detergent containing space 44.

While the detergent container 43 is being contained in the housing 41, the washing water flows through the water supply hose 41*c* of the housing 41. The washing water passes through the nozzle 48 and the water supply hole 44*c* and flows into the detergent containing space 44. The washing water forms a whirling vortex inside the detergent containing space 44 and dissolves the detergent inside the detergent containing space 44. According to an embodiment, since the washing water is directly sprayed by the nozzle 48 coupled with the rear of the detergent containing space 44 and the four sides of the detergent containing space 44 are closed, the washing water rotates and circulates inside the detergent containing space 44. In this process, the blades 46*b* of the rotary device 46 rotate, thereby dissolving the solid detergent.

In addition, according to an embodiment, the liquid detergent may be stably contained while the four sides of the detergent containing space 44 are closed. When the washing water flows through the nozzle 48 and the detergent is dissolved therein, the washing water in which the detergent is dissolved may be discharged through a first flow path inside the siphon pipe 44*a* coupled with the rotary device 46. The rotary device 46 and the siphon pipe 44*a* are coupled with each other with a gap therebetween and form a flow path through which the washing water moves between the rotary device 46 and the siphon pipe 44*a*.

Accordingly, according to an embodiment, since the solid detergent may be dissolved inside the detergent containing space 44 and may change to liquid, the detergent containing space 44 may be used in common for the liquid detergent and the solid detergent. Accordingly, it is unnecessary to change the detergent containing space 44 depending on which one of the solid detergent and the liquid detergent the user uses. Also, due to the rotary device 46, it is possible to dissolve the residual detergent left in the detergent containing space 44, it is unnecessary to use additional washing water for cleaning the detergent containing unit 40, thereby saving the washing water.

Figure 8:
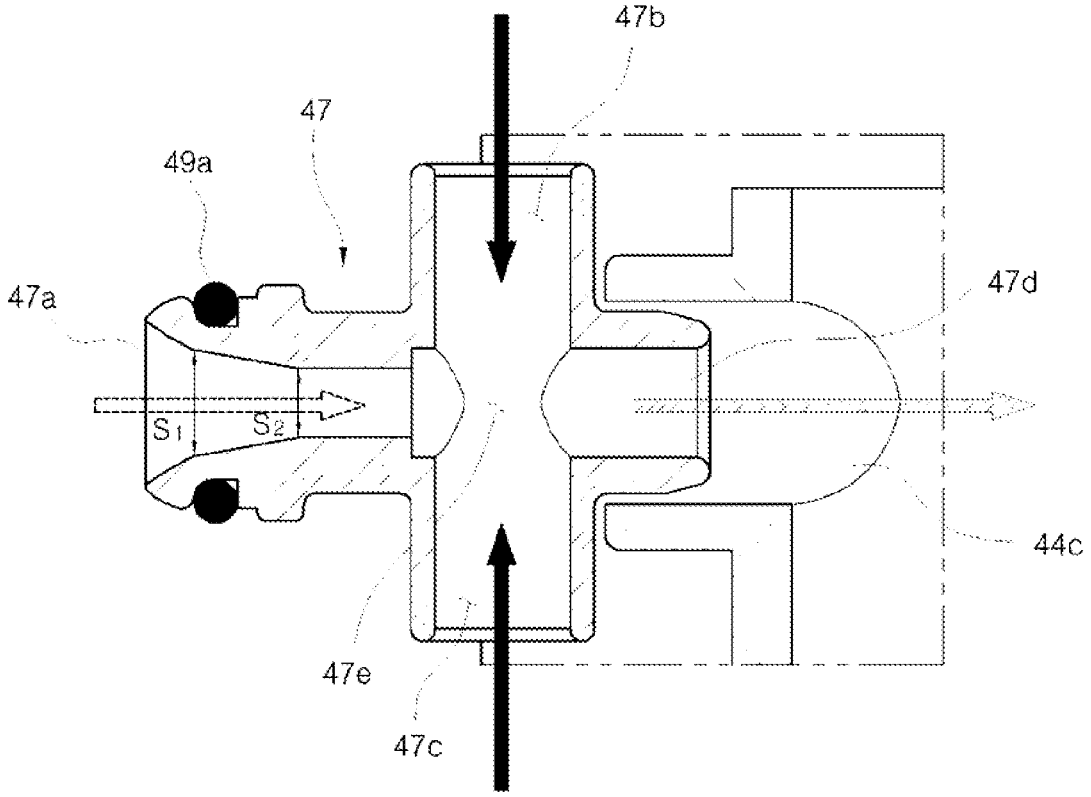
FIG. 8 is an enlarged cross-sectional view of a nozzle of the detergent containing unit in accordance with an embodiment.

FIG. 8 is an enlarged cross-sectional view of the nozzle 47 of the detergent containing unit 40 according to an embodiment. In FIG. 8, an arrow in a dotted line indicates an inflow of the washing water, a solid black arrow indicates an inflow of air, and an arrow with diagonal lines indicates an inflow of the washing water mixed with the air.

As shown in FIG. 8, the nozzle 47 may be coupled with the water supply hole 44*c* of the detergent containing space 44. The nozzle 47 may include the washing water inlet hole 47*a* into which the washing water flows and one or more air inlet holes 47*b* and 47*c*. According to an embodiment, the washing water inlet hole 47*a* and the air inlet holes 47*b* and 47*c* may be formed in the single nozzle 47.

According to an embodiment, the air inlet holes 47*b* and 47*c* may be provided on a top side and a bottom side of the nozzle 47 by ones but it is not limited thereto. Accordingly, the air flowing into the air inlet holes 47*b* and 47*c* may meet and be mixed with the washing water flowing into the washing water inlet hole 47*a* in an intersection flow path 47*e*. After that, the washing water mixed with the air through the washing water inlet hole 47*a* and the air inlet holes 47*b* and 47*c* may pass the water supply hole 44*c* through an integrated inlet hole 47*d* and flow into the detergent containing space 44.

According to an embodiment, the washing water inlet hole 47*a* may decrease in a cross-sectional area toward the air inlet holes 47*b* and 47*c*. That is, the washing water inlet hole 47*a* may include a first section S1 having a first cross-sectional area and a second section S2 having a second cross-sectional area. The second section S2 may be located further inside the washing water inlet hole 47*a* than the first section S1 and may have a smaller cross-sectional area than the first section S1. According thereto, in the second section S2, a pressure of the washing water decreases and the inflow of air is performed smoothly through the air inlet holes 47*b* and 47*c*, thereby mixing the washing water with the air.

Through the nozzle 47, since the washing water is mixed with the air and the washing water mixed with the air flows into the detergent containing space 44, efficiency in dissolving the detergent in the detergent containing space 44 may increase.

Figure 9:
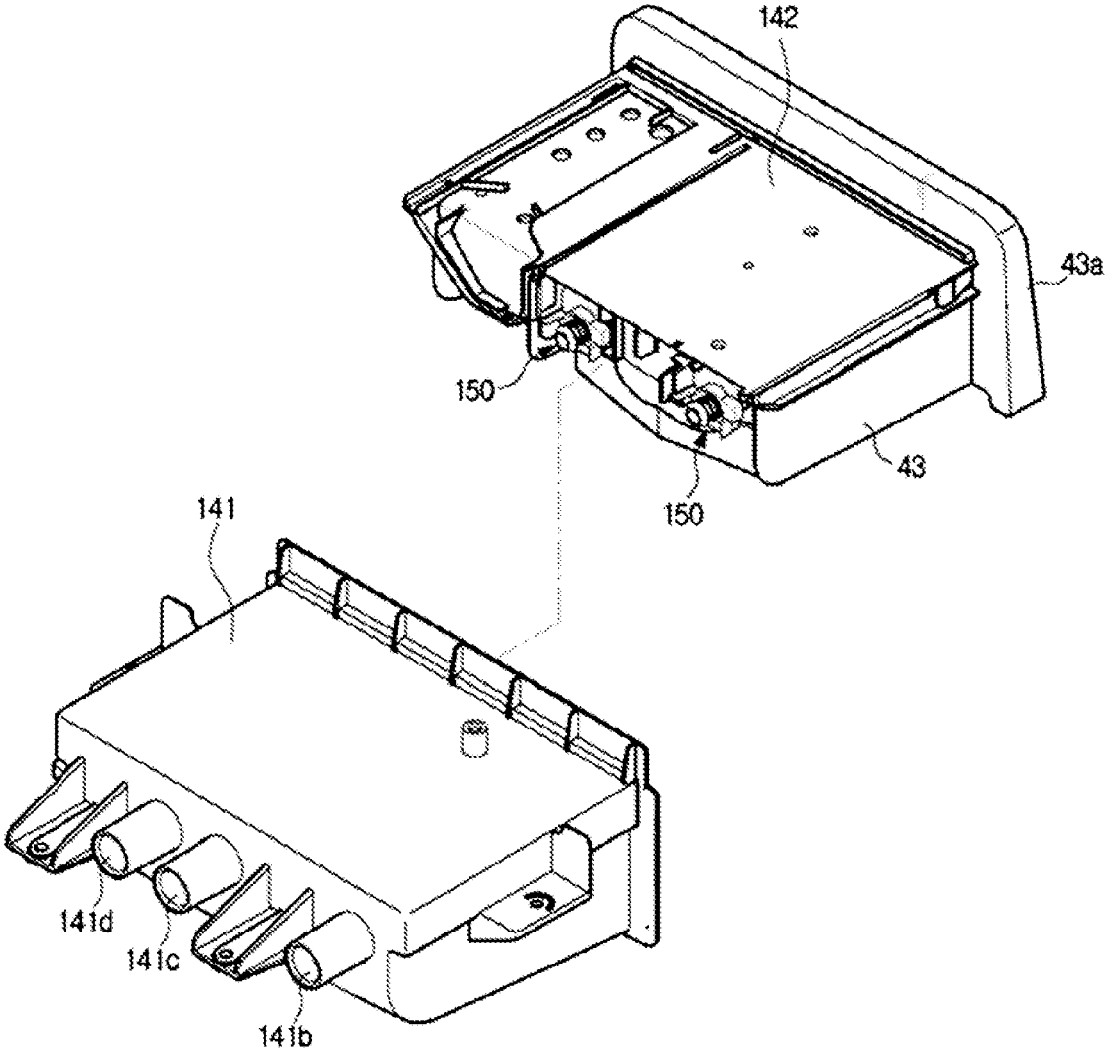
FIG. 9 is a rear view of a detergent container of a detergent containing unit of a washing machine in accordance with another embodiment.
Figure 10:
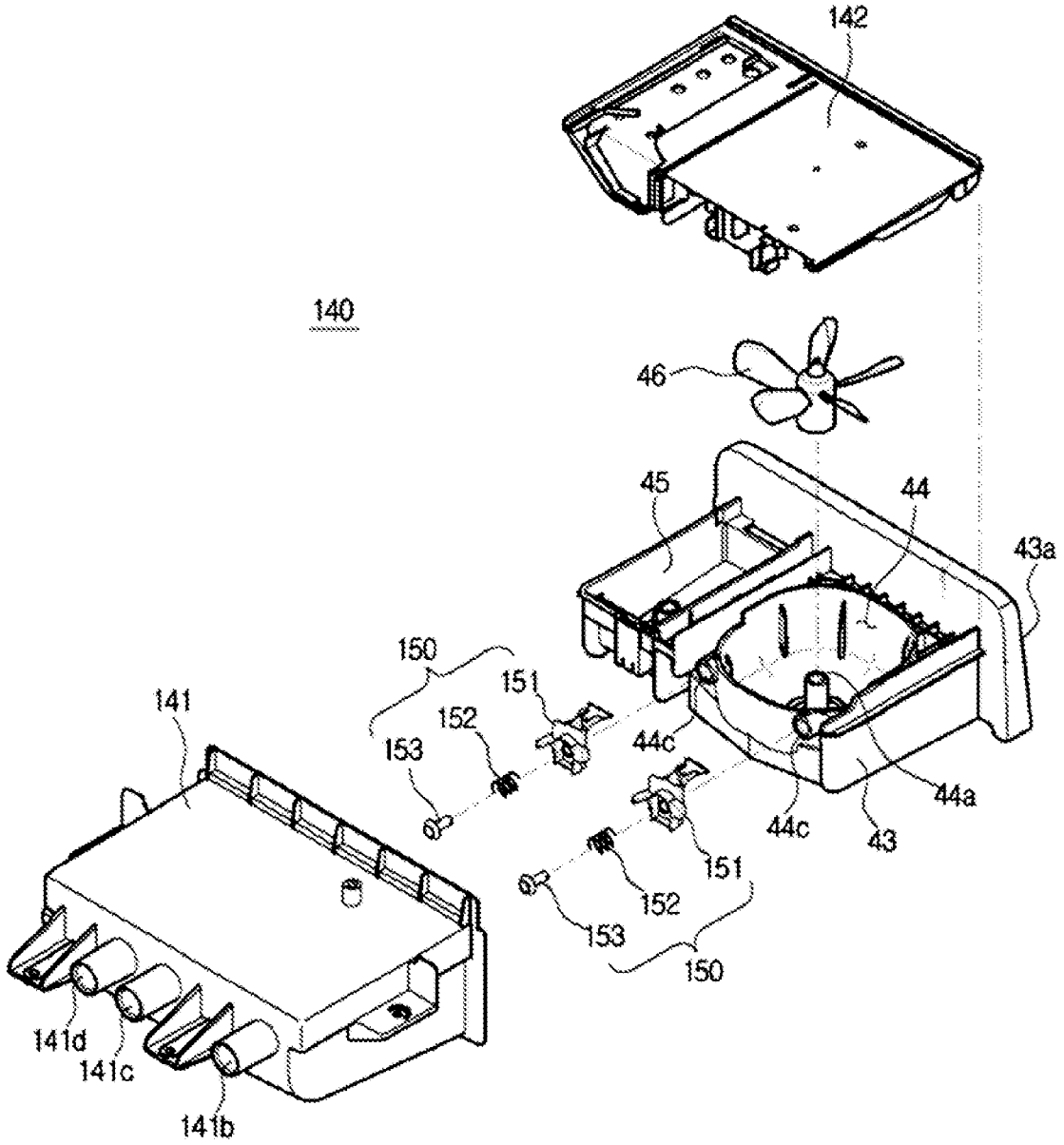
FIG. 10 is an exploded view of the detergent containing unit in accordance with another embodiment.

FIG. 9 is a rear view of a detergent container 43 of a detergent containing unit 140 in accordance with another embodiment. FIG. 10 is an exploded view of the detergent containing unit 140 in accordance with another embodiment.

A description of elements having the same reference numerals will be omitted.

As shown in FIGS. 9 and 10, the detergent containing unit 140 may include a housing 141 and the detergent container 43 contained in the housing 141 and configured to contain a detergent. A guide cover 142 configured to cover the top side of the detergent container 43 may be coupled with the inside of the housing 141.

Water supply hoses 141*b* and 141*c* configured to supply washing water may be provided in a rear side of the housing 141. Also, in the rear of the housing 141, a discharge hose 141*d* configured to discharge the washing water which overflows the detergent container 43 may be provided.

In the rear side of the detergent container 43, water supply holes 44*c* configured to supply the washing water to the detergent container 43 may be provided. The water supply holes 44*c* may communicate with water supply hoses 141*b* and 141*c* of the housing 141.

The water supply hole 44*c* may be coupled with a nozzle device 150 configured to spray the washing water into the detergent container 43. Each of the water supply holes 44*c* may be coupled with one nozzle device 150. According to an embodiment, the water supply holes 44*c* are provided in the detergent container 43 and each of the water supply holes 44*c* may be coupled respectively with one nozzle device 150.

According to an embodiment, the nozzle device 150 may include a nozzle 153 configured to spray the washing water, a nozzle housing 151 configured to contain the nozzle 153, and an elastic member 152 intervening between the nozzle 153 and the nozzle housing 151. The elastic member 152 may guide the nozzle 153 to move toward one of the housing 141 and the detergent container 43 depending on a pressure of the washing water. That is, the nozzle 153 may move forward and backward. This will be described below.

The nozzle device 150 may be installed on the detergent container 43 through a process in which the elastic member 152 is fitted on the nozzle 153, the nozzle 153 is inserted into the nozzle housing 151, the nozzle housing 151 is fitted in the guide cover 142, and the guide cover 142 is coupled with the housing 141. Accordingly, it is possible to more simply assemble the nozzle device 150.

According to an embodiment, the nozzle 153 and the guide cover 142 may be separately provided and the nozzle 153 may be coupled with the guide cover 142. However, it is not limited thereto but a nozzle and a guide cover may be formed as a single member. Also, a nozzle may be integrated to a housing and a guide cover may be assembled therewith.

Figure 11:
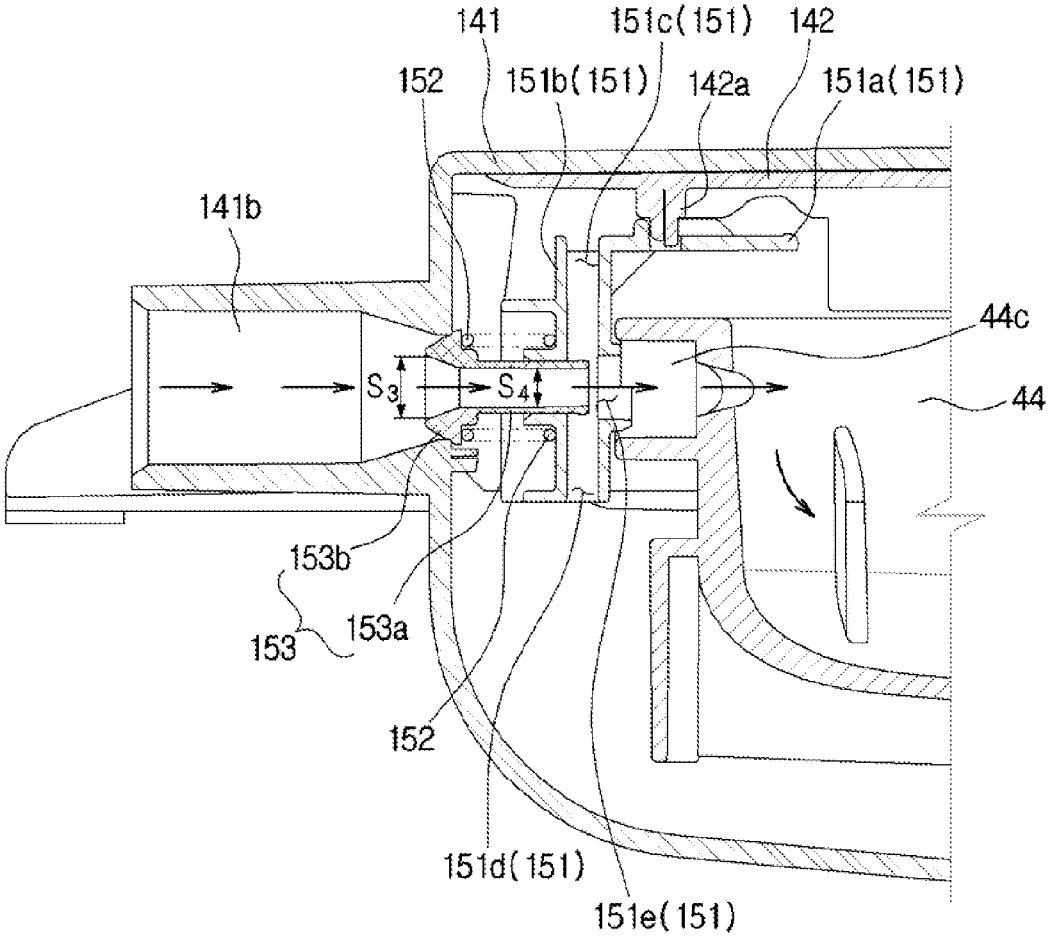
FIG. 11 is a view illustrating a movement of washing water supplied to the detergent containing unit in accordance with another embodiment when a pressure of the washing water is small.
Figure 12:
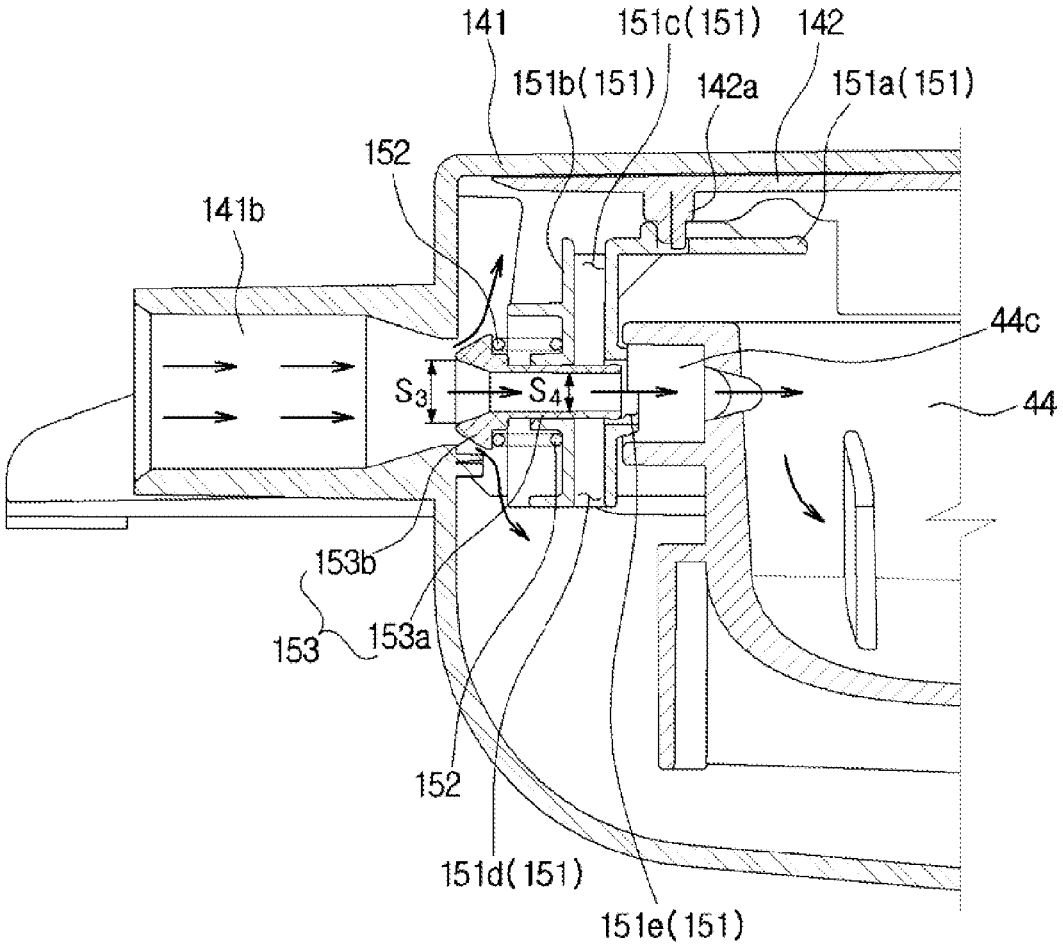
FIG. 12 is a view illustrating a movement of washing water supplied to the detergent containing unit in accordance with another embodiment when a pressure of the washing water is great.

FIG. 11 is a view illustrating a movement of washing water supplied to the detergent containing unit 140 according to an embodiment when a pressure of the washing water is small. FIG. 12 is a view illustrating a movement of washing water supplied to the detergent containing unit 140 according to an embodiment when a pressure of the washing water is great.

As shown in FIGS. 11 and 12, the nozzle device 150 may be located between the water supply hose 141*b* and the water supply hole 44*c*. The nozzle device 150 may be located in a direction from the water supply hose 141*b* to the water supply hole 44*c*, in which the nozzle 153, the elastic member 152, and the nozzle housing 151 are sequentially located.

The nozzle 153 may include a body portion 153*a* and a head portion 153*b* extending from the body portion 153*a*. The washing water flows through the body portion 153*a* and the head portion 153*b*, and the body portion 153*a* and the head portion 153*b* form a washing water inlet hole.

The nozzle housing 151 may include air inlet holes 151*c* and 151*d*. The nozzle housing 151 may include an insertion portion 151*b* including an insertion hole 151*e* into which the nozzle 153 is inserted and a bent portion 151*a* extending from the insertion portion 151*b* and bent. According to an embodiment, the air inlet holes 151*c* and 151*d* may be provided on a top and a bottom of the insertion portion 151*b*, respectively. The insertion hole 151*e* may be provided in the middle of the insertion portion 151*b*.

The guide cover 142 may include a protruding portion 142*a* protruding to the nozzle housing 151. The nozzle housing 151 may be fitted on the protruding portion 142*a*, thereby coupling the nozzle device 150 with the guide cover 142. According to an embodiment, the protruding portion 142*a* may be coupled with the bent portion 151*a* of the nozzle housing 151.

The washing water inlet hole may include a first section having a first cross-sectional area S3 and a second section having a second cross-sectional area S4. The second section may be located further inward than the first section. That is, the second section may be located adjacent to the air inlet holes 151*c* and 151*d*. The cross-sectional area S4 of the second section may be smaller than the cross-sectional area S3 of the first section. That is, the first cross-sectional area S3 of the head portion 153*b* may be greater than the second cross-sectional area S4 of the body portion 153*a*. According thereto, in the second section, a pressure of the washing water decreases and an inflow of air is performed smoothly through the air inlet holes 151*c* and 151*d*, thereby mixing the washing water with the air.

In FIG. 11, the pressure of the washing water is low. In more detail, the pressure of the washing water is smaller than an elastic force of the elastic member 152. Due to the elastic force of the elastic member 152, the nozzle 153 may be coupled with the housing 141 to be in close contact therewith. Accordingly, a flow path through which the washing water moves is not formed between the nozzle 153 and the housing 141 and the washing water passing through the water supply hose 141*b* passes through a flow path inside the nozzle 153 and is sprayed into the detergent container 43 through the water supply hole 44*c*.

In FIG. 12, the pressure of the washing water is high. In more detail, the pressure of the washing water is greater than the elastic force of the elastic member 152. Since the pressure of the washing water is greater than the elastic force of the elastic member 152, the nozzle 153 is coupled to be in close contact with the detergent container 43. Accordingly, a flow path through the washing water moves is formed between the nozzle 153 and the housing 141. Accordingly, some of the washing water passing through the water supply hose 141*b* passes through the inside of the nozzle 153 and is sprayed into the detergent container 43 but the remaining part passes along the outside of the nozzle 153 and is sprayed into the outside of the detergent container 43.

When the pressure of the washing water is high, the centrifugal force of the rotary device 46 becomes greater in such a way that the washing water inside the detergent container 43 may move toward the circumference of the detergent container 43 and overflow the detergent container 43. Accordingly, after the washing water supply stops, the water level of the detergent container 43 becomes lower in such a way that the washing water does not escape through the siphon pipe 44*a*. Accordingly, residual water is left in the detergent container 43. Also, when the pressure of the washing water is high, the efficiency of dissolving the detergent becomes lower.

According to an embodiment, since the nozzle 153 may be movable within a certain distance, when the pressure of the washing water is high, the nozzle 153 may move toward the detergent container 43 and may form a flow path outside the nozzle 153, through which the washing water may move. Accordingly, when the pressure of the washing water is high, since some of the washing water diverges and is supplied to the housing 141, an overflow generated when the washing water with the higher pressure is supplied to the detergent container 43 may be prevented.

Figure 13:
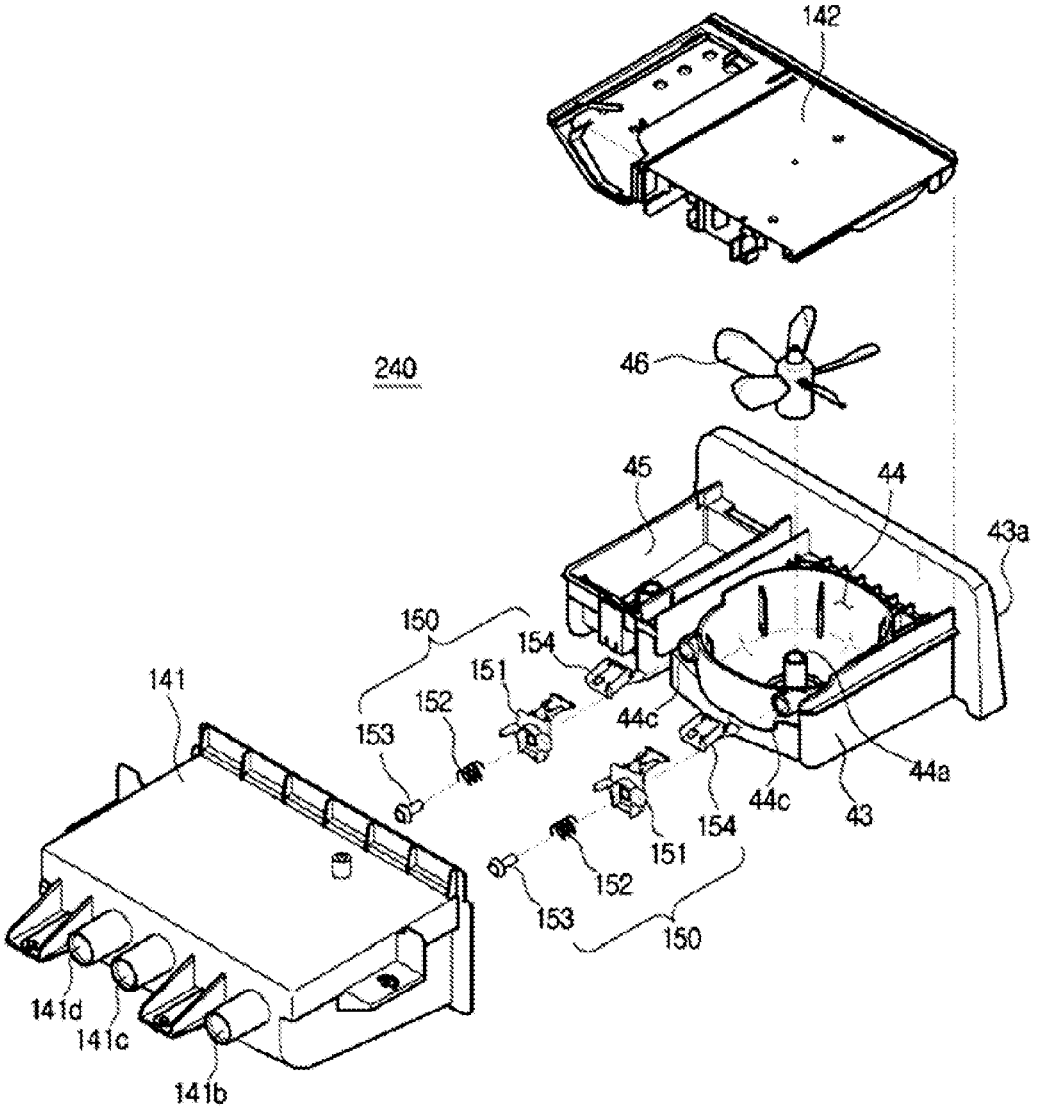
FIG. 13 is an exploded view of a detergent containing unit of a washing machine in accordance with still another embodiment.
Figure 14:
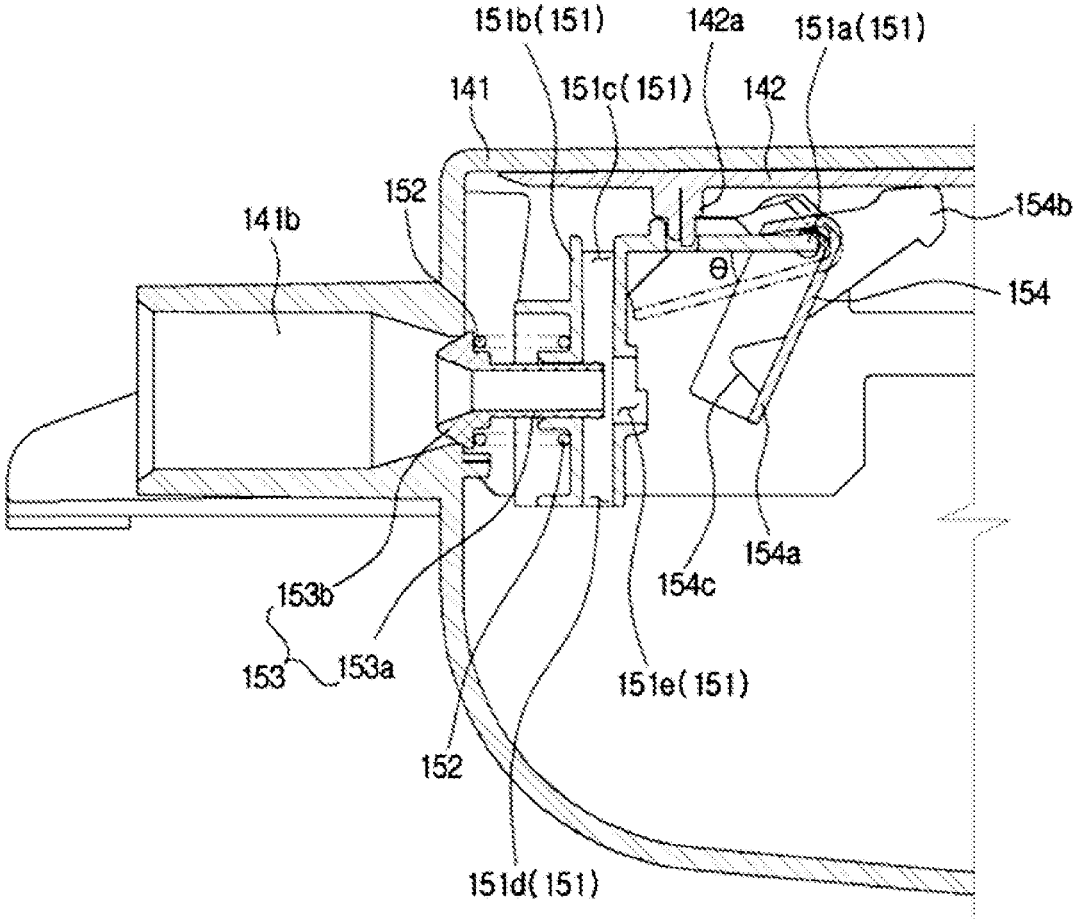
FIG. 14 is a side cross-sectional view of a nozzle device of the detergent containing unit in accordance with still another embodiment.

FIG. 13 is an exploded view of a detergent containing unit 240 in accordance with still another embodiment. FIG. 14 is a side cross-sectional view of the nozzle device 150 of the detergent containing unit 240 according to still another embodiment.

As shown in FIGS. 13 and 14, the nozzle device 150 of the detergent containing unit 240 may further include an inflow preventer 154 configured to open or close a flow path of the washing water. The inflow preventer 154 may include a first state of opening the flow path of the washing water and a second state of closing the flow path of the washing water. The first state indicates a state in which the detergent container 43 is contained in the housing 141. The second state indicates a state in which the detergent container 43 is withdrawn from the housing 141. The inflow preventer 154 may prevent the washing water from being sprayed and supplied to the detergent container 43 when the detergent container 43 is withdrawn from the housing 141. This will be described below.

According to an embodiment, the inflow preventer 154 may be coupled with one side of the bent portion 151*a* of the nozzle housing 151. The inflow preventer 154 may be hinge-coupled with the one side of the bent portion 151*a* and may pivot on the bent portion 151*a*. The inflow preventer 154 may include a coupled portion 154*a* coupled with the nozzle housing 151 and a jaw portion 154*b* configured to be in contact with the detergent container 43 and to allow the inflow preventer 154 to pivot when the detergent container 43 is withdrawn. This will be described below.

Due to the surface tension of the washing water, the inflow preventer 154 may not pivot from the first state to the second state. To prevent this, according to an embodiment, one or more protruding portions 154*c* may protrude from a top side of the coupled portion 154*a*. Also, the coupled portion 154*a* may incline downward toward the bent portion 151*a* in the first state. As an example, an angle (0) formed between the coupled portion 154*a* and the bent portion 151*a* may be 15°. This is to form a certain angle toward the coupled portion 154*a* to guide the washing water but to flow downward and not stay on the coupled portion 154*a*. Also, in the first state, a regular gap g may be formed between the bent portion 151*a* and the inflow preventer 154. The gap g between the bent portion 151*a* and the inflow preventer 154 may be a minimum of about 2 mm. In more detail, the gap g may be formed between the protruding portion 154*c* of the inflow preventer 154 and the bent portion 151*a*. This is to prevent the bent portion 151*a* and the inflow preventer 154 from being in closely contact with each other due to the surface tension of the washing water.

Figure 15:
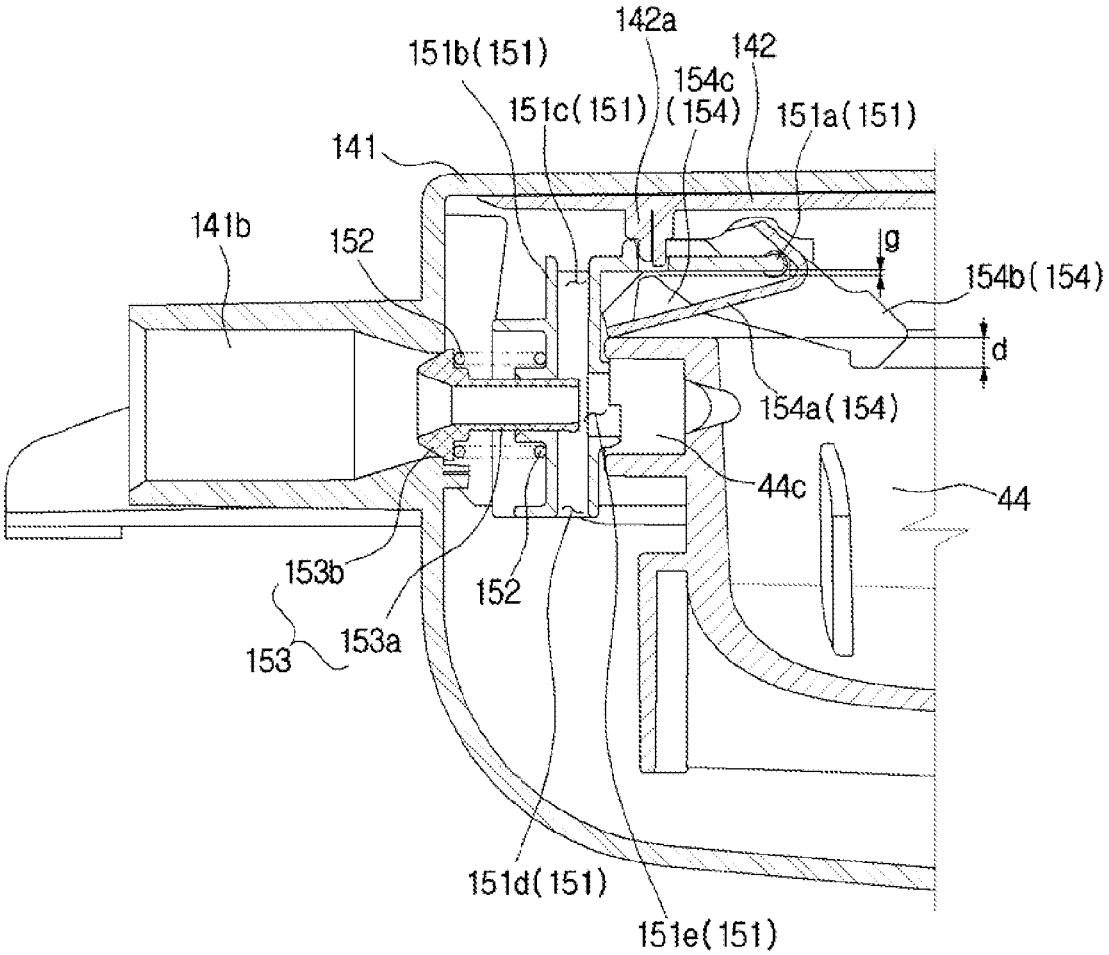
FIG. 15 is a side cross-sectional view illustrating a state in which a detergent container is contained in the detergent containing unit in accordance with still another embodiment.
Figure 16:
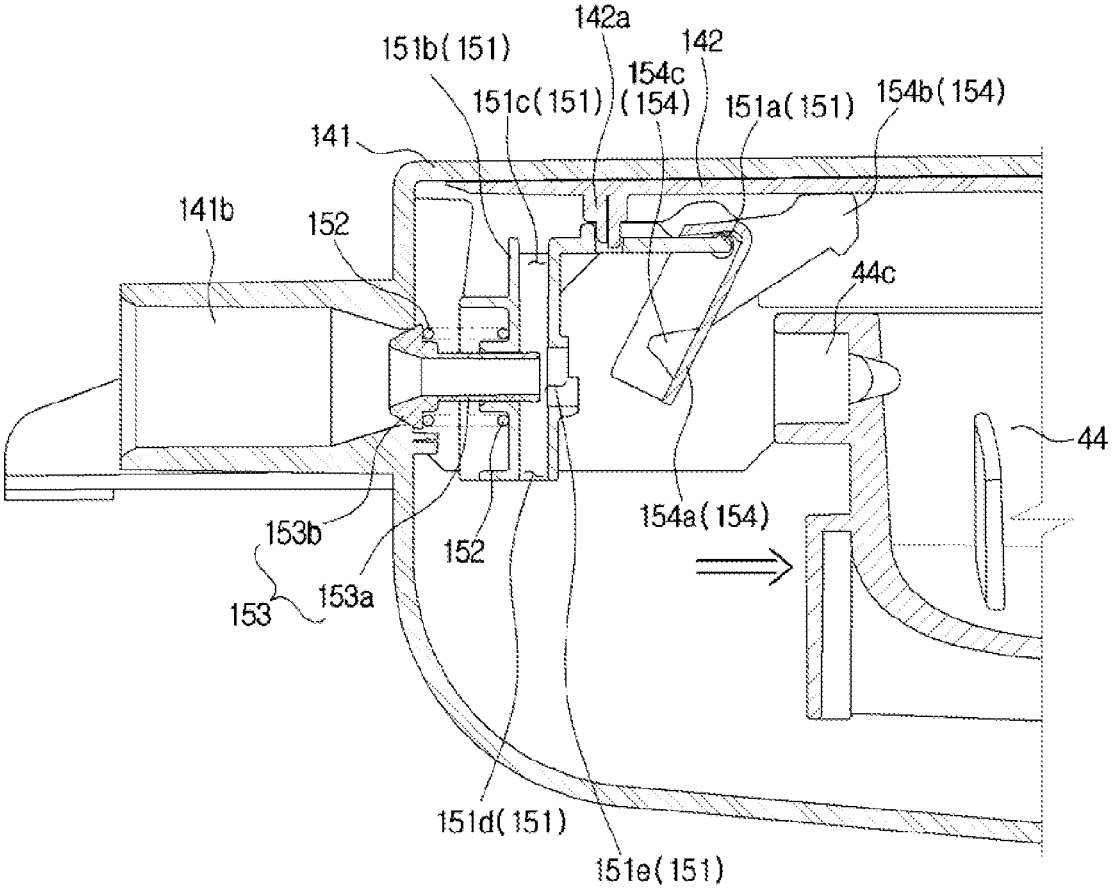
FIG. 16 is a side cross-sectional view illustrating a state in which the detergent container is withdrawn from the detergent containing unit in accordance with still another embodiment.

FIG. 15 is a side cross-sectional view illustrating a state in which the detergent container 43 of the detergent containing unit 240 according to still another embodiment is contained. FIG. 16 is a side cross-sectional view illustrating a state in which the detergent container 43 of the detergent containing unit 240 according to still another embodiment is withdrawn.

FIG. 15 is a view of the inflow preventer 154 in the first state. FIG. 16 is a view of the inflow preventer 154 in the second state.

In the first state, the jaw portion 154*b* may face the inside of the detergent container 43. In the first state, the jaw portion 154*b* may be located at a level lower than a height of the detergent container 43. Accordingly, when the detergent container 43 is being withdrawn from the housing 141, the detergent container 43 is in contact with the jaw portion 154*b* in such a way that the jaw portion 154*b* moves upward and the coupled portion 154*a* pivots, thereby changing the inflow preventer 154 to the second state. As an example, in the first state, a distance d between an uppermost point of the height of the detergent container 43 and a lowermost point of a height of the jaw portion 154*b* may be about 3 mm.

In the first state, the coupled portion 154*a* may be located above the detergent container 43 due to the detergent container 43. Accordingly, a flow path through which the washing water moves from the nozzle device 150 to the detergent container 43 is open, thereby allowing the washing water to move from the nozzle device 150 to the detergent container 43. In the second state, the coupled portion 154*a* pivots downward by gravity. Accordingly, the jaw portion 154*b* coupled with the coupled portion 154*a* may pivot upward. Since the coupled portion 154*a* pivots downward, the flow path from the nozzle device 150 to the detergent container 43 is closed. Accordingly, when the detergent container 43 is withdrawn, it is possible to prevent the washing water from flowing into the detergent container 43.

Figure 17:
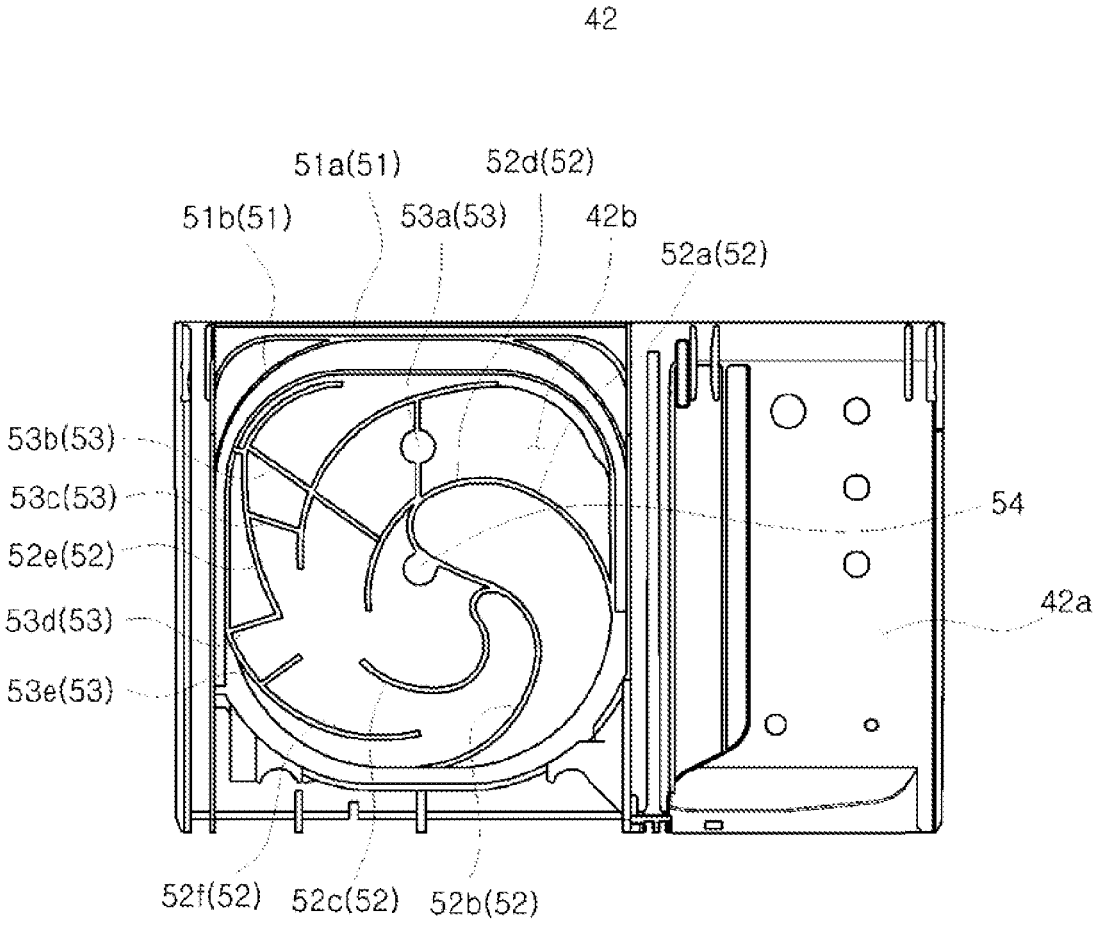
FIG. 17 is a bottom view of a guide cover of the detergent containing unit of in accordance with the embodiment.

FIG. 17 is a bottom view of the guide cover 42 of the detergent containing unit 240 according to an embodiment.

As shown in FIG. 17, on a bottom of the guide cover 42, to guide a moving direction of the washing water flowing into the detergent container 43, there may be provided one or more ribs 51, 52, and 53 extending from the bottom of the guide cover 42 toward the detergent container 43. According to an embodiment, the guide cover 42 may include a softener containing space cover 42*a* located on a top side of the softener containing space 45 and a detergent containing space cover 42*b* located on a top side of the detergent containing space 44. The one or more ribs 51, 52, and 53 may be located on the detergent containing space cover 42*b*.

The ribs 51, 52, and 53 may be provided in a different direction from each other. In more detail, a first rib 51 may be provided on a front side of the guide cover 42. The first rib 51 may surround a front side of the detergent containing space 44 to prevent the washing water supplied to the detergent containing space 44 from overflowing the front side of the detergent container 43. The first rib 51 may include an outer first rib 51*a* provided outward and an inner first rib 51*b* provided inside the outer first rib 51*a* and diverging from the outer first rib 51*a*.

A second rib 52 nearly circularly extends from the center of the guide cover 42 toward an edge thereof. The second rib 52 may be provided to guide the washing water to the center of the detergent containing space 44. According to an embodiment, the second rib 52 may have a spiral shape formed from the outside to the center to collect the washing water being pushed outward due to centrifugal force in the center. According to an embodiment, the second rib 52 may include six second ribs 52*a*, 52*b*, 52*c*, 52*d*, 52*e*, and 52*f* and one of them may diverge from another. However, it is not limited thereto.

A third rib 53 may extend radially from the center of the guide cover 42 toward the edge thereof. The third rib 53 may be configured to intensively supply the washing water to a particular section. Due to the third rib 53, when residual detergent is left in the particular section, the washing water may be intensively supplied, thereby dissolving the detergent. According to an embodiment, the third rib 53 may be located in the front side of the detergent containing space cover 42*b*. This is to guide the inflow of the washing water to the third rib 53 to dissolve the residual detergent because the washing water flows from a rear side of the detergent containing space 44 and the residual detergent remains in the front of the detergent containing space 44. According to an embodiment, the third rib 53 may include, for example, five third ribs 53*a*, 53*b*, 53*c*, 53*d*, and 53*e* and one of them may diverge from another. Also, the third rib 53 may diverge and extend from the second rib 52.

The guide cover 42 may further include a contact preventer 54 provided in the center to prevent a contact with the rotary device 46. Since the rotary device 46 is coupled with the detergent containing space 44, the contact preventer 54 may be provided on the detergent containing space cover 42*b*, which is a location corresponding thereto. The contact preventer 54 may be configured to maintain a minimum gap from the coupled portion 46*a* of the rotary device 46. For this, the contact preventer 54 may protrude below the guide cover 42 to be located at a level lower than the ribs 51, 52, and 53. The rotary device 46 may rotate and receive a lift due to a flow of the washing water and may ascend toward the guide cover 42. Herein, since noise may occur when the rotary device 46 is in contact with the ribs 51, 52, and 53, the contact preventer 54 may be located in the position corresponding to the rotary device 46, thereby preventing contact between the rotary device 46 and the guide cover 42.

As is apparent from the above description, a washing machine according to an embodiment increases a detergent dissolving ability.

According to an embodiment, it is possible to dissolve both solid detergent and liquid detergent in one detergent containing unit without an additional component.

Also, since it is possible to prevent residual detergent from being left in a detergent containing unit after washing, it is unnecessary to additionally use a rinse function to clean the detergent containing unit.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:
- a body;
- a tub disposed inside the body; and
- a detergent containing unit including:
  - a housing,
  - a detergent container housed in the housing,
  - a siphon pipe vertically extending from a bottom side of the detergent container to communicate an inside of the detergent container with an outside of the detergent container, and
  - a rotary device rotatable inside the detergent container about the siphon pipe, the rotary device including
    - a coupled portion detachably coupled to the siphon pipe such that a flow path is formed between an inside of the coupled portion and the siphon pipe, and
    - a plurality of blades extending radially from the coupled portion.

2. The washing machine of claim 1, wherein the detergent container comprises a water supply hole disposed at a side surface of the detergent container such that the rotary device is rotated by water supplied through the water supply hole.

3. The washing machine of claim 1, further comprising:
- a nozzle device disposed at a side wall of the detergent container, the nozzle device including a washing water inlet hole and at least one air inlet hole to supply water mixed with the air to the detergent container.

4. The washing machine of claim 3, wherein a cross-sectional area of the washing water inlet hole of the nozzle device decreases toward the air inlet hole.

5. The washing machine of claim 3, wherein the washing water inlet hole and the air inlet hole of the nozzle device are formed as a single member.

6. The washing machine of claim 3, wherein the nozzle device comprises:

a nozzle in which the washing water inlet hole is formed; and a nozzle housing in which the nozzle is inserted and the air inlet hole is formed.

7. The washing machine of claim 6, further comprising:

an elastic member inserted between the nozzle housing and the nozzle, the elastic member configured to press the nozzle depending on a pressure of the water, which flows into the nozzle, to guide the nozzle to move forward and backward.

8. The washing machine of claim 3, wherein the nozzle device further comprises:

an inflow preventer configured to close a flow path through which the water flows, to prevent the water from flowing into the detergent container when the detergent container is withdrawn.

9. The washing machine of claim 1, further comprising:

a guide cover disposed at an upper portion of the housing to supply water into the detergent container.

10. The washing machine of claim 9, wherein the guide cover comprises at least one rib configured to extend downward from the guide cover to guide the moving direction of the water.

11. The washing machine of claim 10, wherein the at least one rib comprises:

a first rib provided on a front side of the guide cover to prevent the supplied water from overflowing a front side of the detergent container;

a second rib configured to extend from a center of the guide cover toward an edge thereof to guide the water to a center of the detergent container; and a third rib configured to radially extend from the guide cover toward the edge to intensively supply the water to a specific section.

12. The washing machine of claim 10, wherein the guide cover further comprises a contact preventer provided in a center thereof and located at a level lower than the at least one rib to prevent a contact of the guide cover with the rotary device.

13. A washing machine comprising:

a body;

a rotary tub disposed inside the body;

a detergent housing;

a detergent container accommodated in the detergent housing;

a siphon pipe vertically extending from a bottom side of the detergent container to discharge detergent contained in the detergent container;

a rotary device disposed inside of the detergent container to be rotatable about the siphon pipe; and a nozzle device configured to supply water into the detergent container to cause the rotary device to rotate.

14. The washing machine of claim 13, wherein the nozzle device is coupled to a side wall of the detergent container.

15. The washing machine of claim 13, wherein the nozzle device comprises a washing water inlet hole and at least one air inlet hole to mix the water with air and supply the water mixed with the air to the detergent container.

16. The washing machine of claim 15, wherein a cross-sectional area of the washing water inlet hole decreases toward the air inlet hole.

17. The washing machine of claim 13, wherein the rotary device includes:

a coupled portion detachably coupled to the siphon pipe, and a plurality of blades extending radially from the coupled portion.

18. The washing machine of claim 13, further comprising:

a guide cover disposed above the detergent container when the detergent container is accommodated in the detergent housing and configured to supply water into the detergent container.

19. A washing machine comprising:

a body;

a rotary tub disposed inside the body; and a detergent container detachably coupled from inside of the body and comprising a detergent containing space to contain a detergent, wherein the detergent container comprises:

a rotary device disposed in the detergent containing space, and including a coupling portion, and a plurality of blades extending radially from the coupling portion, and a siphon pipe protruding vertically from a bottom side of the detergent container to discharge detergent contained in the detergent container, wherein the rotary device is rotatable about the siphon pipe by water supplied into the detergent container.

20. The washing machine of claim 19, further comprising:

a nozzle coupled to a side wall of the detergent container to supply water into the detergent containing space.

21. The washing machine of claim 19, further comprising:

a guide cover disposed above the detergent container when the detergent container is positioned inside the body, and comprising at least one rib to guide a direction of the water being supplied to the detergent container.

22. A washing machine comprising:

a tub to store water;

a detergent container to store detergent;

a rotary device disposed in the detergent container so that, when water is supplied to the detergent container, the supplied washing-water causes the rotary device to rotate about a vertical axis and thereby agitate the water contained in the detergent container; and a siphon pipe to discharge the detergent dissolved in the water from the detergent container, wherein at least a portion of the siphon pipe is coupled to the rotary device and extends along the vertical axis.

23. The washing machine of claim 22, further comprising:

a nozzle to supply the water to the detergent container with a pressure so that the supplied water causes the rotary device to rotate.

* * * * *